United States Patent [19]

Wilhelm

[11] 4,185,280

[45] Jan. 22, 1980

[54] METHOD OF AND APPARATUS FOR MONITORING OR CONTROLLING THE OPERATION OF A BOOM-TYPE CRANE OR THE LIKE

[75] Inventor: Wolfgang Wilhelm, Ratingen-Hösel, Fed. Rep. of Germany

[73] Assignee: Kruger & Co. KG, Essen-Werden, Fed. Rep. of Germany

[21] Appl. No.: 865,304

[22] Filed: Dec. 28, 1977

[30] Foreign Application Priority Data

Dec. 31, 1976 [DE] Fed. Rep. of Germany ..... 2659755

[51] Int. Cl.[2] ..... B66C 15/06; G08B 21/00

[52] U.S. Cl. ..... 340/685; 212/39 A; 364/424; 364/508

[58] Field of Search ..... 340/685, 686; 364/424, 364/463, 508, 512, 556, 567, 568; 212/39 R, 39 A; 73/133 R

[56] References Cited

U.S. PATENT DOCUMENTS

| | | | |
|---|---|---|---|
| 3,586,841 | 6/1971 | Griffin | 364/508 |
| 3,638,211 | 1/1972 | Sanchez | 364/463 X |
| 3,740,534 | 6/1973 | Kezer et al. | 364/424 X |
| 4,006,347 | 2/1977 | Hohmann | 340/685 X |
| 4,052,602 | 10/1977 | Horn et al. | 364/424 |
| 4,078,668 | 3/1978 | Hohmann | 340/685 X |

FOREIGN PATENT DOCUMENTS 2006722 2/1970 Fed. Rep. of Germany .

*Primary Examiner*—John W. Caldwell, Sr.
*Assistant Examiner*—Joseph E. Nowicki
*Attorney, Agent, or Firm*—Karl F. Ross

[57] ABSTRACT

The operation of a boom-type crane or the like is monitored or controlled and, especially, a setpoint signal is generated which represents the total load moment for any given set of crane-operating parameters so that this setpoint signal can be compared with an actual-value signal and the crane operator alerted or crane operation terminated when the actual value of the boom-load moment approaches the maximum permissible value thereof. According to the invention, three storage units are provided, the first storing a value of the crane-boom intrinsic moment as a function of the crane parameters, the second storing a unit-load moment value as a function of the crane parameters and the third storing values of the maximum permissible load moment per unit load. A controller is provided to carry out arithmetic operations on signals from the three storage units and, more particularly, for multiplying the output signals of the second and third storage units and adding to the resulting product a signal representing the value from the first storage unit as a function of the crane-operating parameters. The crane-operation parameters are generally the horizontal and vertical angles of the crane boom and the length thereof.

12 Claims, 4 Drawing Figures

METHOD OF AND APPARATUS FOR MONITORING OR CONTROLLING THE OPERATION OF A BOOM-TYPE CRANE OR THE LIKE

FIELD OF THE INVENTION

The present invention relates to a method of and to a system for monitoring and/or controlling the operation of a crane boom and, more particularly, to a system for generating a setpoint signal allowing the monitoring of the crane boom and representing maximum permissible total load moment of this boom.

BACKGROUND OF THE INVENTION

In U.S. Pat. No. 3,638,211, there is described a crane safety system for warning the operator of a crane when the crane is about to overturn due to the moment of heavy load or when the weight of that load could cause structural failure of the crane. In that arrangement, sensors are provided for measuring the boom length, the boom angle, the condition of the crane support, and the quadrant in which the crane is operating. These sensors are connected to the crane and apply signals to the computer which selects previously stored information from a memory unit depending upon the signals received. This stored information is applied to a comparator which compares the stored signal against a measured load signal and provides a warning alarm to the crane operator when the two signals approach each other.

In this prior-art device, the memory unit is a single memory in which the highest permissible load moment is stored as a function of the crane parameters directly. The highest permissible load moment includes, as is known, the intrinsic moment of the crane boom, i.e. the portion of the load moment due to the weight and length of the boom, and the highest permissible load moment resulting from the application of various loads to the boom. This latter component can be treated as a loading moment and can be thought of as the moment resulting only from the presence of a load of given magnitude at the end of the boom. Since this load varies from time to time in the operation of the crane and, indeed, may be an unpredictable value, the total load moment which is applied to the crane boom is likewise indeterminate and depends upon the weight of the boom, its extension, the angle of the boom and the aforedescribed loading.

While the highest permissible load value, as a function of the crane parameters for various crane booms is constant for one and the same type of boom crane, the intrinsic load moment is thus the instantaneous or loaded moment for any given set of crane operating parameters has a specific value for each crane boom.

The crane parameters referred to above and hereinafter are generally the boom length and thus the boom extension, the angle of the boom in a vertical plane and the angle of the boom in a horizontal plane.

If it is desired to provide a setpoint signal of high precision for comparison for a measured-value for actual-value signal to provide the warning or to control the operation of the boom, e.g. by terminating the displacement thereof when the actual value signal approaches the setpoint signal, it has been the practice heretofore to provide for each individual boom-type crane a set of maximum permissible total load moment values as a function of these crane parameters by measuring the instantaneous total load moment, for example, of a lifting piston-cylinder arrangement of the crane boom for loads which are increased progressively in stages. These signals are stored in the single memory of the aforementioned U.S. patent or otherwise programmed therein.

Such measurements are time consuming and expensive. This is even the case when the highest permissible load values are already known because of variations in the intrinsic load moment of the crane booms from crane to crane. Usually these measurements must be taken over the wide range of capacity of the crane and over the wide ranges of operation of the boom with respect to the aforementioned angles and boom length. Naturally, if the maximum permissible load value varies from crane to crane because of different constructions of the crane boom, the number of measurements is inordinately increase.

OBJECTS OF THE INVENTION

It is the principal object of the present invention to provide an improved device for obviating the disadvantages described above and for facilitating the generation of a high-precision set-point signal representing the maximum permissible total load moment as a function of the crane parameters.

Another object of the invention is to provide an improved method of and control system for generating a warning for the operator of a crane for controlling the crane by terminating the operation thereof whereby the disadvantages of earlier systems are obviated.

SUMMARY OF THE INVENTION

These objects and other which will become apparent hereinafter are attained, in accordance with the present invention, in a device which eliminates the need to store individually all of the highest permissible total load moment values as a function of the crane parameters but nevertheless provides a setpoint signal for the purposes described of high precision and with a substantially reduced determination cost. The problem solved by the invention is of greatest significance when the boom-type crane must be supplied to a party other than the manufacturer who has determined the highest permissible loading values and for a manufacturer which produces a wide range of cranes having booms of various intrinsic load moments and load-carrying capacity. It is also of significance when the crane is provided with an automatic monitoring device of the type described previously.

The invention resides in forming the memory of the control system from three functionally distinct memory units including a first memory unit in which the intrinsic moment of the crane boom is stored as a function of the aforementioned crane parameters, a second memory unit for storing a so-called unit load moment as a function of the crane parameters and a third memory unit for storing the maximum permissible load value per unit load as a function of the crane parameters, and a processing unit for multiplying the output signals of the second and third memory units and thereafter adding the output signal of the first memory unit to the product thus obtained.

For the purposes of the present invention, the intrinsic moment value of the crane boom as a function of the crane parameters is understood to refer to the measured values over the range of crane parameters of the moment of the crane boom without loading. The unit-load moment value as a function of the crane parameters will be understood to mean the distribution to the measured value of the crane-boom moment of a unit weight for the crane parameters and thus is the difference between the actual measured value, as thus noted, and the measured values stored in the first memory unit.

The arithmetic functions of the central processor unit of the present invention can thus be understood in terms of the relationship $S=A+(CD)=A+[(B-A)D]$.

In the aforementioned relationship, A is defined as the intrinsic beam moment (unloaded) at any given set of crane parameters, B is the total unit-loading moment and hence is the intrinsic beam moment plus a unit load moment at the same set of parameters, C is the unit-load moment for this set of parameters, and D is the maximum permissible load moment per unit load moment. S is the setpoint value representing the maximum permissible load moment at the given set of crane parameters. The central processing unit thus carries out the multiplication and addition steps represented in the foregoing relationship.

The subdivision of the memory of the control system into three units and the obtention of the setpoint signal by the arithmetic operations from the three memory units has the advantage that the measuring time and measuring steps necessary to set up the memories and provide the setpoint signal for any given set of crane parameters and the total range thereof is substantially reduced. It is only necessary to measure, as a function of the crane parameters, the load moment value of the unloaded and unit loaded crane boom. By varying the maximum permissible crane load value, no repetition of these measurements is required.

The device of the present invention can be integrated with a monitoring system although it is possible to provide the system of the present invention completely external of the crane and to use it for establishing the setpoint signal for all sets of crane parameters and to transfer the setpoint signals to the memory of each monitoring system for each crane.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
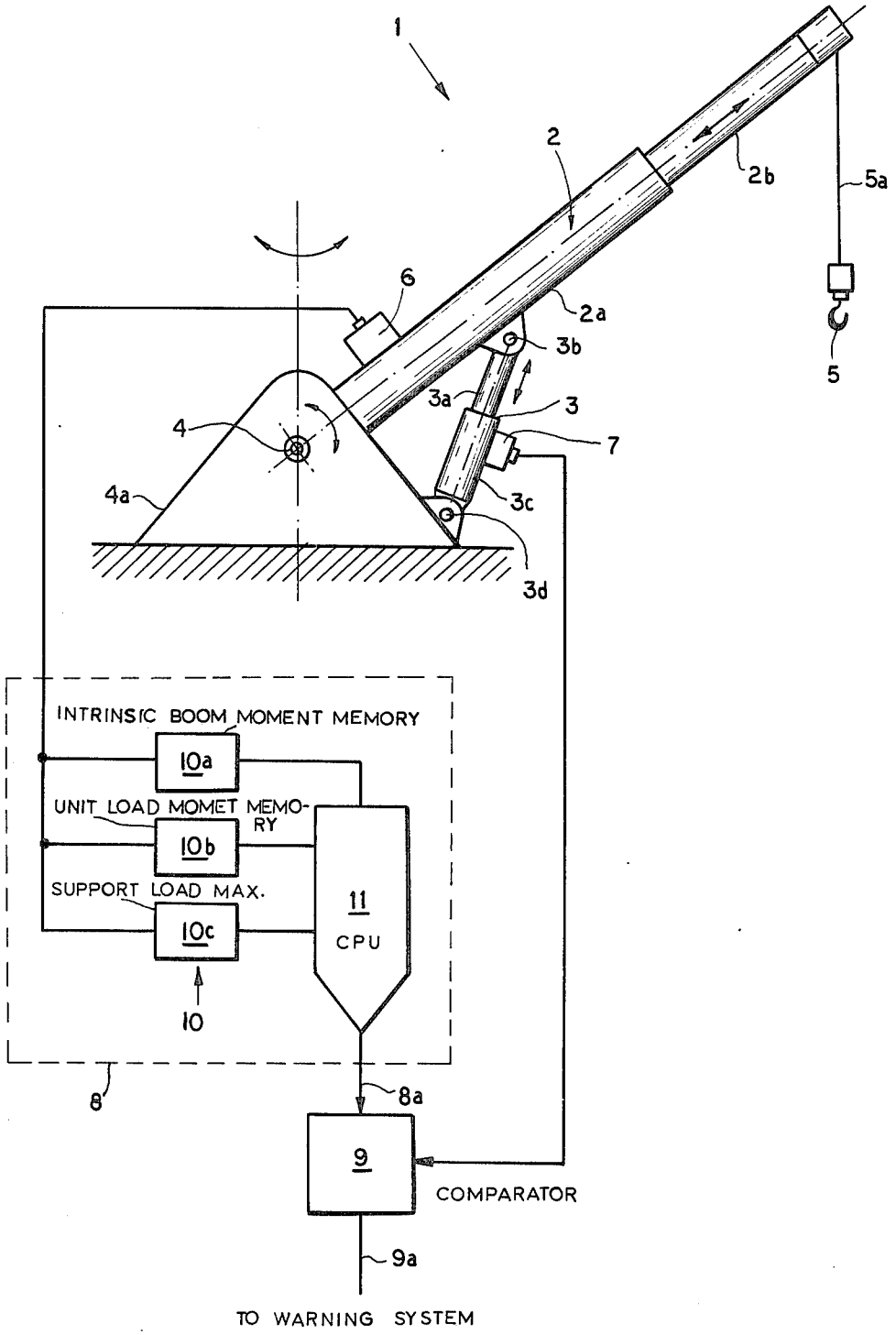
FIG. 1 is a diagrammatic elevational view of a crane according to the present invention showing a system for carrying out the principles of the invention.

FIG. 1 shows in highly diagrammatic form a boom-type crane having a telescoping crane boom 2 which is swingably mounted at 4 upon a pair of trunnions represented diagrammatically at 4*a*. The crane 1 is here shown to be of the type tilted by a hydraulic piston-and-cylinder arrangement represented at 3, this cylinder arrangement having a piston 3*a* pivotally connected to the lower member 2*a* of the boom 2 at a hinge 3*b*. The cylinder portion 3*c* is, in turn, articulated to the supports 4*a* as represented at 3*d*. The supports 4*a* can be rotatable about a vertical axis on a vehicle platform in which case the degree to which the boom 2 is swung about this vertical axis can constitute one of the crane parameters.

The outer member 2*b* of the boom 2 is telescopingly received within the lower member 2*a* and carries, over a pulley not shown, a cable 5*a* carrying a hook engageable with a load.

In place of the cylinder arrangement 3, the boom 2 can be raised and lowered by a windlass (see the aforementioned patent). Furthermore, the extension or effective length of the boom 2 can be adjusted by supplying hydraulic fluid to the lower member 2*a* which can act as a cylinder for which member 2*b* is a piston. A further windlass can raise or lower the cable 5*a* to raise or lower the load attached to the hook 5. All of these control and drive devices are well known per se and have not, therefore, been illustrated or described herein.

The crane boom 2 is provided with a sensor 6 which has been shown diagrammatically and serves for the measurement of the crane parameters. Details of the sensor 6 and various parts thereof will be apparent from FIG. 3 and can be of the type shown in the aforementioned patent. The measuring device illustrated diagrammatically at 6 generates output signals representing the boom length and the angular position of the boom. The cylinder arrangement 3 is provided with a sensor 7, the output of which represents the instantaneous total load moment and serves as the actual-value or measured-value signal which is applied to a comparator 9. In practice, the sensor 7 can be a pressure transducer which converts the pressure supplied to the cylinder 3*c* into an electrical signal representing this pressure, this signal being transferred via an analog/digital converter to the control system which is preferably of the digital type as will be apparent from the discussion with respect to FIG. 3.

The measuring system 6 is connected to a device for generating the setpoint signal representing the maximum permissible load moment. This device has been represented at 8. The setpoint signal is applied via line 8*a* to the comparator 9. The comparator 9 has as its output a signal at 9*a* which can be applied to the crane-monitoring device.

In the comparator 9, the setpoint signal is compared with the actual-value or measured-value signal and as the measured-value signal approaches the setpoint signal, a control output is applied to the crane-control signal which terminates operation of the cylinder arrangement 3. A warning signal can also be given to the operator as discussed below.

The setpoint-value generator 8 is of the digital-electronic type and can comprise a memory controlled by the measuring unit 6 and a processor (central processing unit) 11 connected to the memory 10.

According to the invention, the memory 10 is constituted from three memory units. The first memory unit 10*a* has an output which represents the intrinsic moment of the crane boom for any given set of crane parameters.

The second memory unit 10*b* stores and delivers a unit-load moment value while the third memory unit 10*c* stores and delivers the maximum permissible support load value per unit load, as a function of the crane parameters.

The three memory units 10*a*, 10*b* and 10*c* are connected to a processor (central processor unit or CPU) 11 which carries out the arithmetic operations described previously. In other words, the output signals of the second and third memory units 10b and 10c are multiplied together and the product is thereafter added to the output signal of the first storage unit 10a to give the corresponding setpoint value representing the maximum possible load moment at any given set of crane parameters.

The storage of the data in the three memory units 10a, 10b and 10c is effected as follows:

First, using the sensor 7, the intrinsic moment value of the crane boom 2 is measured as a function of the crane parameters with the corresponding values being stored in the first memory unit 10a. Next, using the sensor 7 and suspending a unit load from the load hook 5, the moment on the crane boom 2 is measured as a function of the crane parameters and reduced by the corresponding stored value of the intrinsic moment, the difference being applied to the second memory unit 10b.

Finally, the maximum permissible load value per unit load is measured as a function of the crane parameters and is stored in the memory unit 10c.

When the aforedescribed setpoint value generator 8, as shown, is to be an integrated part of the monitoring device, the output signals of the first and second memory units can be used during operation to calculate and indicate the instantaneous load.

Figure 2:
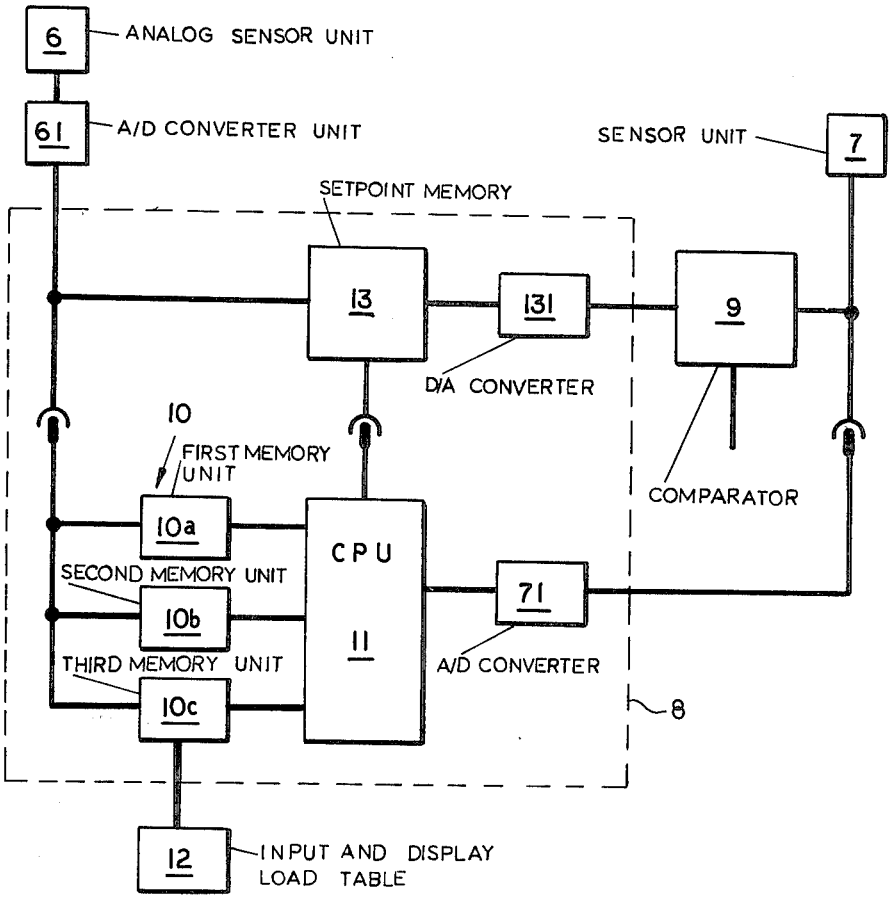
FIG. 2 is a block diagram of a system of the present invention in which the memory units and arithmetic processor of FIG. 1 are shown to be connected to the crane-operation monitoring system.
Figure 3:
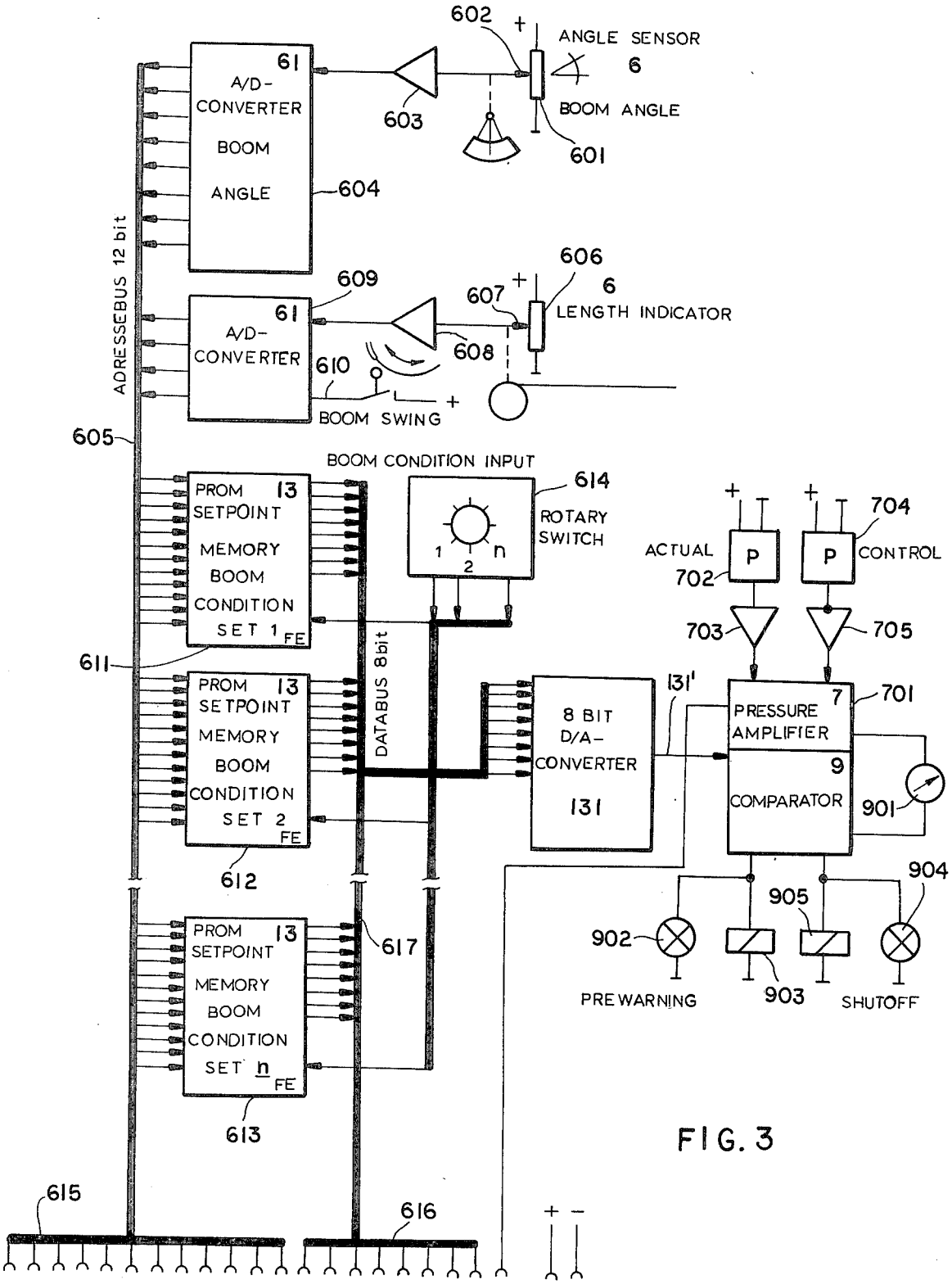
FIGS. 3 and 4 are block diagrams showing the system or portions of the system of FIG. 2 is greater detail.

FIG. 3 shows a circuit in somewhat greater detail, this circuit including an analog detector 601 forming one of the sensors which have been most generally represented at 6 in FIG. 2. The sensor 601 can be a potentiometer connected across a voltage source and having its wiper 602 connected to the crane boom so that an angular position thereof produces a corresponding voltage signal which is applied through an amplifier 603 to an analog digital converter 604. The analog-digital converter stages are represented collectively at 61 in FIG. 2 as will be apparent hereinafter. In other words, the analog angular-position signal is converted by the A/D converter for the boom angle into a train of bits representing this angular position and applied to the address bus 605.

The other crane parameters are detected by analog sensors and are applied to the address bus 605 as corresponding digital pulse trains. For example, the boom length can be detected by a variable resistor 606, forming one of the sensors of the sensor unit 6 and connected across a direct current source. The wiper 607 of this potentiometer can be connected to one of the telescoping members 2a, 2b while the potentiometer body is connected to the other.

The voltage analog signal representing the length of the boom is applied through an amplifier 608 to a further analog/digital converter 609 of the A/D conversion unit 61 which produces the corresponding train of digital pulses. Another input to the A/D converter 609 may be a line 610 which applies an analog signal representing the swing of the crane boom about a vertical axis so that this parameter is likewise taken into account.

The analog/digital converters of the unit 61 be of the type described at Chapter 8, pages 2–3 and 23–27, or Chapter 11, pages 6–9 and 13–24, of *Handbook of Telemetry and Remote Control*, McGraw-Hill Book Co., New York, 1967.

The sensors 601 and 606 and the associated amplifiers may be of the type described at pages 44–66 of *Servomechanism Practice*, McGraw-Hill Book Co., New York, 1960.

According to the invention, the address bus 605 feeds n programmable read-only memories (PROMs) which constitute part of the PROM unit 13 (FIG. 2) and have been represented at 611, 612 and 613 respectively. The PROMs store the crane operating parameters, namely, the values of the angle of the boom about a horizontal axis and in a vertical plane, the angle of the boom about a vertical axis and the length of the boom. The PROMs can be of the type described in the aforementioned patent. The n PROMs are sampled in accordance with conventional commutation or sequencing techniques using a rotary switch 614 having n positions and as described in principle in Chapter 11, pages 7 ff. of *Handbook of Telemetry and Remote Control*. The resulting condition setting is applied to an eight bit digital-/analog converter 131 (see Chapter 8, pages 43 ff of *Handbook of Telemetry and Remote Control*) which delivers the setpoint signal via line 131' to the comparator 9.

The comparator is also connected to a pressure-difference amplifier 701 which is represented in FIG. 2 by the sensor 7 and responds to the measured pressure in the cylinder 3. More specifically, the amplifier 701 receives a signal from a first pressure detector 702 representing the measured value of the pressure through an amplifier 703. In addition, the amplifier 701 receives a signal from a pressure detector 704 responding to the control pressure and applying its signal via the amplifier 705 to unit 701. An indicator 901 may be connected between the differential pressure amplifier 701 and the amplifier 9 to indicate the load moment.

As the setpoint value is approached by the measured value of the load moment, the comparator 9 operates a warning light 902 and a relay 903 which can energize an acoustic alarm. When the measured value signal reaches the setpoint value, a light 904 is energized to signal this fact to the crane operation and a relay 905 is energized to immobilize the hydraulic control system and prevent further operation of cylinder 3.

The twelve-bit address bus 605 is connected by a multiterminal connector 615 to the male contacts of a multiterminal connector 100 of the memory 10. The memory 10 has an address bus 101 which feeds random access memories 102, 103, 105–108 which form the memory units 10a–10c previously described. The address bus 101 also feeds a read only memory (ROM) 104.

The random access memory (RAM) 102 stores the values of the boom angle while RAM 103 stores the values of the boom length. Since the moment is determined as a function of the cosign of the boom angle, the values of the cosigns for corresponding angles are stored in the ROM 104. The radius value is stored in RAM 105 while RAM 106, corresponding to memory unit 10a, stores the pressure values from the cylinder 3 corresponding to the intrinsic moment of the boom. The pressure corresponding to the unit-load contribution to the total moment is stored in RAM 107 which thus corresponds to the unit 10b. The loading table of the crane, i.e. the maximum permissible load per unit load, is stored in RAM 108 which corresponds to the memory unit 10c.

The aforedescribed RAMs and ROMs feed the data bus 109 which is connected by male contacts 110 to a female multicontact connector 616 connected to the data bus 617 and feeding the D/A converter 131. The data bus 109 also feeds the CPU 11 which carries out the arithmetic operations previously described and outputs to the necessary control units as described in the aforementioned patent or the other publications cited herein. For instance, the CPU 11 outputs to the address decoder 111, the principles of which are similar to those described at Chapter 11, pages 62 ff. of the *Handbook of Telemetry and Remote Control.* The CPU 11 also feeds the data bus 109, a RAM program memory 112 and a PROM programmer 113.

The CPU 11 is also provided with a clock represented by the quartz crystal 114, the clock serving to generate the necessary clock pulses for operating the system.

The system also includes a keyboard 120, forming part of an input and display arrangement generally represented at 12 for enabling manual data input to the system, e.g. to introduce the load table into the memory 10*c* or, in the case illustrated in FIG. 3, RAM 108. The keyboard 120 can be a conventional calculator keyboard having an entry key 121. The entered data can be viewed by the operator on an alpha-numeric display 122.

A simplified version of the system described in FIG. 3 is found in FIG. 2 in which the sensor unit is shown at 6 to be connected to the analog/digital converter unit 61 which, in turn, feeds, via appropriate bus connectors, the setpoint value memory 13 the output of which is applied to the D/A converter 131 to the comparator 9. The sensor unit 7 provides the actual value signal to the comparator 9 which can be connected to the various warning systems which have previously been described at 901–905. From FIG. 2 it will be apparent that the elements of the system shown at 10, 11 and 71 may be disconnected from the remainder thereof, which is provided directly on the crane, and need only be used to initially produce the setpoint values to be recorded in the memory 13. Naturally, when the setpoint memory 13 is not employed, the output of the arithmetic processing unit 11 can be applied directly through the D/A converter 131 or otherwise to the comparator 9 (see FIG. 1).

In the system of FIG. 2, moreover, the block 12 represents the input and display unit for introducing the load table to the memory unit 10*c*. In addition, the inputs which derive from the cylinder 3 and detected by the sensor unit 7 is delivered through a further A/D converter 71 to the CPU 11 or, as has been shown in FIG. 4, to the data bus 109.

Figure 4:
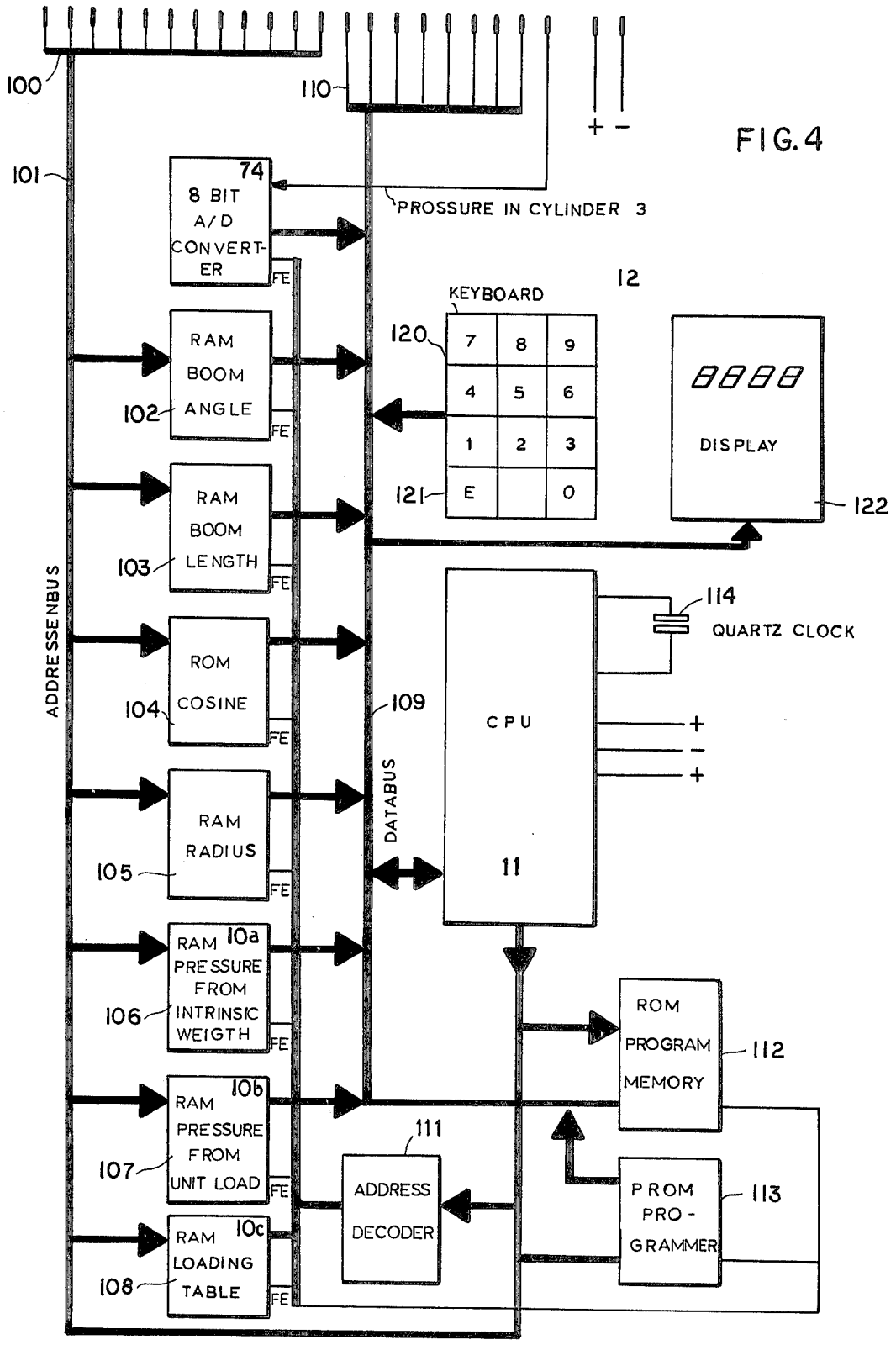

All of the components of the system of FIGS. 3 and 4, to the extent that they have not been described previously are known in the art and can be of the type described in the aforementioned patent or the publications therein cited.

I claim:

1. A method of monitoring the operation of a crane boom which is tiltable in a vertical plane through an angle constituting a first parameter, swingable through an angle about a vertical axis constituting a second parameter and extendable to a degree constituting a third parameter, said method comprising the steps of:

(a) detecting and recording in a first memory unit the intrinsic load moment of said boom as a function of operating conditions of the boom including at least some of said parameters:

(b) detecting and recording in a second memory unit the moment of a unit load applied to said boom as a function of said conditions;

(c) recording in a third memory unit maximum permissible load values for the load applied to said boom per unit load;

(d) deriving respective signals form each of said memory units;

(e) multiplying the signals of said second and third units to form a product and adding thereto the signal from said first unit to produce a maximum permissible load setpoint signal;

(f) detecting the total load moment on said boom and producing an actual-value signal corresponding thereto under the instantaneous prevalent set of conditions;

(g) comparing said actual-value signal with said setpoint signal for the corresponding conditions; and (h) generating a warning signal upon the actual-value signal approaching said setpoint signal under the given set of conditions.

2. The method defined in claim 1, further comprising the step of terminating displacement of said boom automatically when said actual value signal is equal to said setpoint signal under the given conditions.

3. The method defined in claim 1, further comprising the step of recording said setpoint signal as a function of said conditions in a programmable read only memory and tapping said read only memory to draw a corresponding setpoint value therefrom for given conditions of operation of the boom.

4. A device for producing a setpoint signal representing the highest permissible total load moment of a crane boom having a plurality of operating conditions which affect the total load moment and define the positions of a load-carrying end of said boom, said device comprising:

a first memory unit for storing intrinsic moment values for the unloaded crane boom as a function of said conditions, a second memory unit for storing values of the contribution to the load moment on said boom of a unit load suspended from said end, a third memory unit for storing values of the maximum permissible loads per unit load as a function of said conditions; and a processor receiving respective values from said first, second and third memory units for multiplying the values received from said second and third units and adding to the resulting product the value received from said first unit to form a setpoint signal.

5. In a control system for monitoring the operation of a crane boom having a plurality of operating conditions which affect the total load moment and define the positions of a load-carrying end of said boom, the improvement which comprises:

a device for producing a setpoint signal representing the highest permissible total load moment of said boom, said device comprising:

a first memory unit for storing intrinsic moment values for the unloaded crane boom as a function of said conditions, a second memory unit for storing values of the contribution to the load moment on said boom of a unit load suspended from said end, a third memory unit for storing values of the maximum permissible loads per unit load as a function of said conditions; and a processor receiving respective values from said first, second and third memory units for multiplying the values received from said second and third units and adding to the resulting product the value received from said first unit to form a setpoint signal, means for detecting the instantaneous load moment of said boom at any given set of such conditions for producing an actual-value signal;

comparator means for comparing said setpoint signal with said actual value signal and producing an output at least upon said actual value signal approaching said setpoint signal; and means connected to said comparator for alerting an operator of the crane upon the development of said output.

6. The improvement defined in claim 5, further comprising a programmable read only memory connected to said processor and receiving said setpoint signal therefrom for recording said setpoint signal as a function of said conditions, and means for tapping setpoint signals from said memory for application to said comparator in accordance with the specific conditions under which the crane is operated.

7. The improvement defined in claim 5, further comprising a keyboard and display unit connected to said third memory unit for registering therein the values of the maximum permissible loads per unit load as a function of said conditions.

8. The improvement defined in claim 5, further comprising a sensor for measuring said conditions and the intrinsic moment values for the unloaded crane boom and the contribution of the load moment on said boom of a unit load suspended from said end.

9. The improvement defined in claim 5 wherein said memory units and said processor are digital devices and said comparator is an analog comparator, further comprising a digital/analog converter connected to said comparator for converting said setpoint signal into a corresponding analog value.

10. The improvement defined in claim 5 wherein said boom is raisable and lowerable by a cylinder arrangement connected to said boom, further comprising means for detecting the pressure in said cylinder arrangement and for converting the detected pressure to said actual value signal.

11. The improvement defined in claim 10, further comprising an analog/digital converter connected to said processor for transforming said actual-value signal into a corresponding digital value and applying same to said processor.

12. The improvement defined in claim 5, further comprising means immobilizing said boom upon said actual value signal coinciding with said setpoint signal.

* * * * *